US007413250B2

(12) United States Patent
Connolly et al.

(10) Patent No.: US 7,413,250 B2
(45) Date of Patent: Aug. 19, 2008

(54) BACK SUPPORT

(75) Inventors: Sean W Connolly, San Diego, CA (US); Brian A Blair, San Diago, CA (US)

(73) Assignee: Blair Connolly, Inc., San Diego, CA (US)

( * ) Notice: Subject to any disclaimer, the term of this patent is extended or adjusted under 35 U.S.C. 154(b) by 0 days.

(21) Appl. No.: 11/602,844

(22) Filed: Nov. 21, 2006

(65) Prior Publication Data

US 2008/0116730 A1 May 22, 2008

(51) Int. Cl.
*A47C 4/54* (2006.01)
*A47C 7/46* (2006.01)

(52) U.S. Cl. ..... 297/284.6; 297/284.7; 297/452.3; 297/452.41

(58) Field of Classification Search ..... 297/452.41, 297/284.6, 284.4, 284.7, 452.3
See application file for complete search history.

(56) References Cited

U.S. PATENT DOCUMENTS 4,097,087 A * 6/1978 Garavaglia ..... 297/284.7 X
7,059,678 B1 * 6/2006 Taylor ..... 297/284.6 X
2007/0001505 A1 * 1/2007 Marshall et al. ..... 297/452.41 X

OTHER PUBLICATIONS

<www.ergogenesis.com/eg/products/> Printed Jan. 22, 2007 Original Publication Date Unknown; 4 pages.
2006 Integral Orthopedics Inc., Moller Back Support System™, p. 1.
Arc Web Catalog, p. 17.
Therapeutic Inc., Back Support—Features, p. 1.
Contour Living, Solutions for Home & Health, Contour Freedom Back® Support Cushion, pp. 1-4.
Safe Computing, Best Value Task Chairs Section, pp. 1-6.
Office Master Value Patriot PA59 Discount Ergonomic Task Office Chair Shop at comfort channel, pp. 1-3.
The Comfort Store, HAG Ergonomic Chairs, pp. 1-4.
Keilhauer Product Brochure, "Sguig Syncro Designed by EOOS", entire brochure, 2006.

* cited by examiner

*Primary Examiner*—Anthony D Barfield
(74) *Attorney, Agent, or Firm*—Mintz, Levin, Cohn, Ferris, Glovsky and Popeo, P.C.; Michael D. Van Loy

(57) ABSTRACT

A thoracic back support allows for and assists in the promotion of scapular retraction in a seated human. In various examples, such supports may be rigid or semi-rigid, and they may be convex.

21 Claims, 22 Drawing Sheets

Prior Art

Top down view: office chair

Prior Art

Side View: office chair

Top down view: thoracic back support

Side View: with thoracic back support

BACK SUPPORT

CROSS-REFERENCE TO RELATED APPLICATIONS

Not applicable.

BACKGROUND OF THE INVENTION

The following includes information that may be useful in understanding the present inventions. It is not an admission that any of the information provided herein is prior art, or material, to the presently described or claimed inventions, or that any publication or document that is specifically or implicitly referenced is prior art.

1. FIELD

Embodiments of the present invention relate to, but are not limited to, the field of human back support. More particularly, embodiments of the invention relate to thoracic back support for chairs and other seating apparatuses.

2. BACKGROUND

A significant number of people in the United States experiences low back pain at some point in their lives. This back pain may result in pain of a level ranging from inconvenient to debilitating. Back pain may also result in lost productivity due to missed work.

Most chairs and other seating apparatuses (including, for example, couches and the like) have a concave shape to the back support, as shown in FIG. 2 and FIG. 3. This concave shape moves a seated individual's shoulder girdle into an anterior position, resulting in scapular protraction. Because the human body is a kinetic chain, with adjustments to the position of one part of the body affecting the alignment of other parts of the body, this scapular protraction may have a detrimental effect on a person's spinal alignment. Most chairs tend to flatten the natural curve of the lumbar vertebrae (a hypo-lordotic condition) while increasing the curve of the thoracic vertebrae (a hyper-kyphotic condition) and accentuating the cervical curve (a hyper-lordotic position). Further discussion of these conditions may be found, for example, in *Basic Biomechanics*, Susan J. Hall, 3rd ed, 1999, which is incorporated by reference herein. These conditions may contribute to back pain. As shown in FIG. 3, even a chair with a good lumbar support, if promoting scapular protraction, does not align the spine correctly through all three curves.

It would be beneficial to provide a back support, chair, or other seating apparatus that reduces or eliminates one or more of the conditions caused by scapular protraction. It would further be desirable to provide a back support, chair, or other seating apparatus that would promote scapular retraction, thereby eliminating one or more of the conditions described above.

BRIEF SUMMARY OF THE INVENTION

The present invention relates to a thoracic back support for a chair or other seating apparatus. A back support of the invention has a convex thoracic support column that promotes scapular retraction in a person seated on a chair or other seating apparatus bearing the back support. A thoracic support column, preferably a convex thoracic support column, provides a back support that allows and/or promotes scapular retraction in a seated person. A column may be a freestanding column or may be integrated into a more traditional chair back. Embodiments of the invention may also include a lumbar support, as shown in FIG. 1.

An embodiment of the invention includes a method for promoting scapular retraction in a person in a seated or reclining position, comprising providing a thoracic support column and a seat appended thereto and performing at least one of sitting or reclining against said thoracic support column, wherein pressure resulting from said sitting or reclining against said thoracic support column promotes scapular retraction. A further embodiment of the invention provides a chair comprising a seat, a plurality of legs depending from the seat, and a back attached to the seat, wherein the back comprises a thoracic support column.

The thoracic support column may comprise a back of a chair. The chair may be, for example, but is not limited to folding chairs, rolling chairs, stadium seats, love seat, couch, stackable chairs, student chairs, airplane seats, helicopter seats, office chairs, school chairs, dining chairs, theater seats, watercraft seats, and ground vehicle seats.

The thoracic support column may be a convex thoracic support column. The thoracic support column may include a central groove. A scapular indentation may be situated on either side of a thoracic support column. A headrest, a lumbar support, a plurality of armrests, a footrest, a swivel mechanism, a height-adjustment assembly, a front-axis pivot, a mid-axis pivot, a horizontal seat adjustment, a seat length adjustment, a seat-tilt adjustment, a split in said seat, a horizontal adjustment for said back, a vertical adjustment for said back, a vibration function, a heating function, a cooling function, a thermostat, and/or a tilt for said back may be provided.

A thoracic support column may comprise a fluid bladder having a filled state and an unfilled state. The user of a chair with a fluid bladder may be able to adjust the fluid bladder between said filled state and said unfilled state to provide a thoracic support column of varying rigidity.

A thoracic back support column may be rigid or semi-rigid. In some embodiments, the thoracic support column is about 2 inches to about 8 inches wide at its base, about 2 inches wide at its topmost point, and about 0.75 inches to about 3.5 inches deep from its apex. The chair back may consist of a thoracic support column. The thoracic support column may be, for example, a cylinder, and elliptic cylinder, and a cylindrical section.

An embodiment of the invention may include a thoracic support for a seating apparatus or reclining apparatus, wherein said thoracic support comprises a convex column.

BRIEF DESCRIPTION OF THE SEVERAL VIEWS OF THE DRAWINGS

FIG. 9 depicts the chair with a fabric mounting, and FIG. 8 depicts a chair without a fabric mounting.

DETAILED DESCRIPTION OF THE INVENTION

Figure 1:
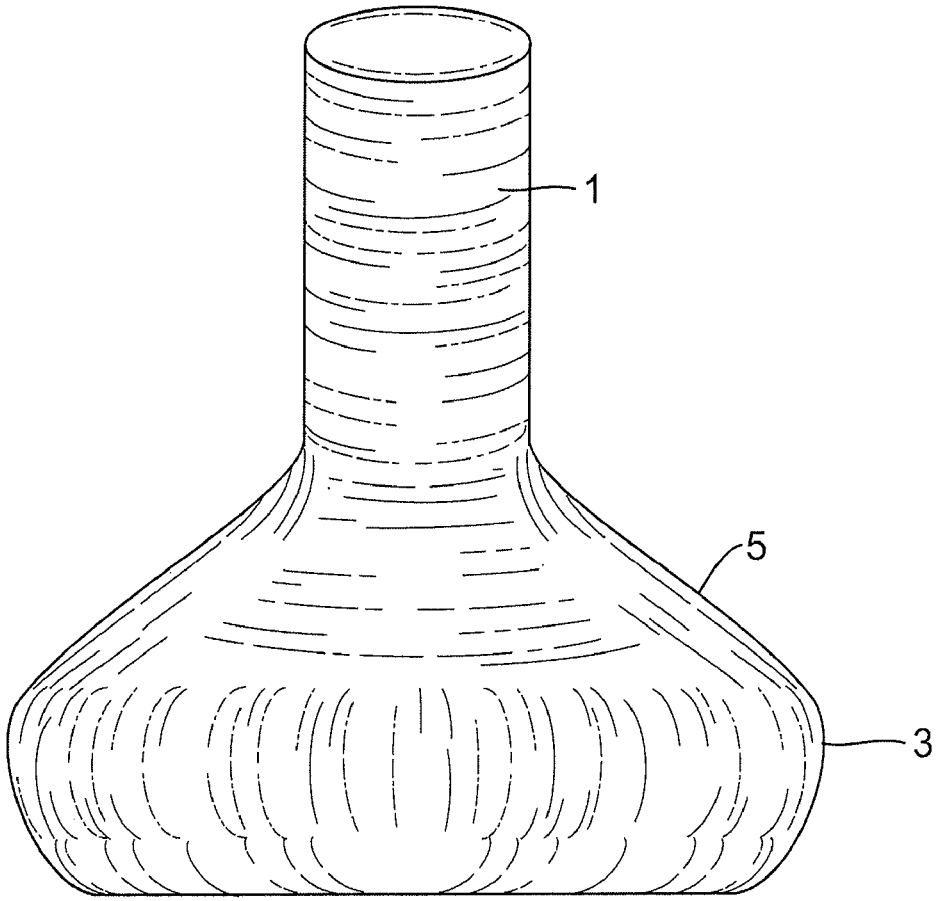
FIG. 1 depicts a back support of one embodiment of the invention.
Figure 2:
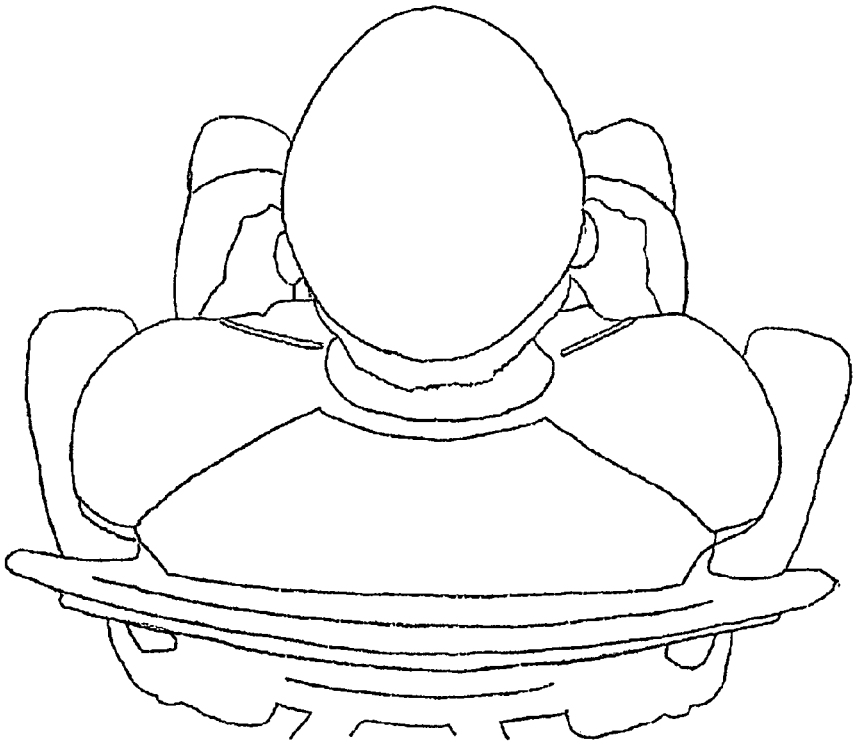
FIG. 2 depicts a top view of an office chair with a back support of the prior art, along with an outline of an individual seated in that chair. The individual exhibits a rounded shoulder shape and forward head position.
Figure 3:
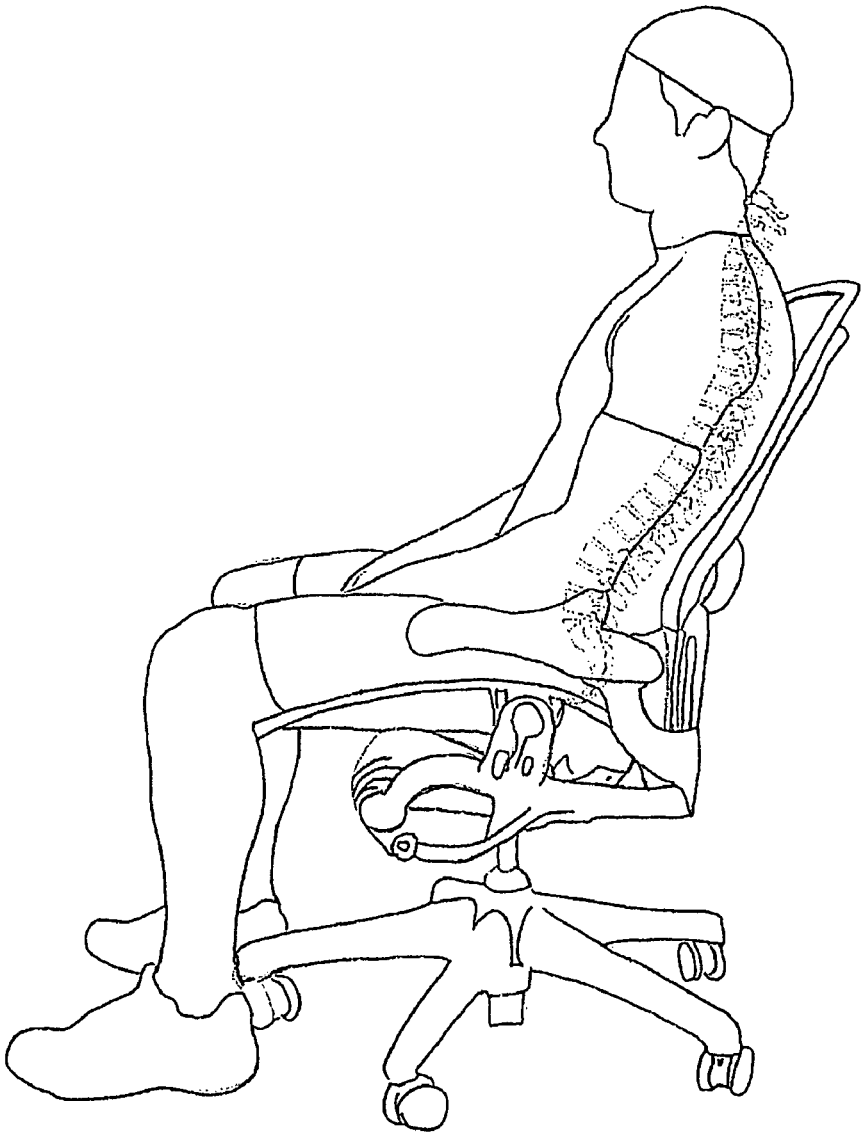
FIG. 3 depicts a side view of an office chair with a back support of the prior art, along with an outline of an individual seated in that chair and an example of neutral spine alignment. The back support promotes scapular protraction and a consequent forward position of the shoulder girdle, resulting in an exaggerated thoracic curve and an inability of the body to align correctly with the natural curve of the spine.

Embodiments of the invention will now be described with specific reference to the figures. Referring to FIG. 1, an embodiment of the invention is shown. It includes a thoracic support column 1, a lumbar support 3, and a tapered bevel 5 adjoining the lumbar and thoracic supports. In this embodiment of the invention, at least the portion of the thoracic support column that may come into contact with a seated individual is convex. Although the thoracic support column is depicted as an elliptic cylinder in this embodiment, other embodiments may include a cylinder, half cylinder, or other curved surface. In some embodiments a thoracic support column may appear to be only a portion of a cylinder or elliptic cylinder extending from the plane of the seat back.

Other embodiments of the invention may include a thoracic support column but no lumbar support, or a thoracic support column and lumbar support but no tapered bevel. Seating incorporating a back support of the invention should also include a horizontal seating surface; however, one may also recognize that a back support alone may be placed in a horizontal position and used as a place for a person to recline.

In some embodiments of the invention the angle of the back support relative to the seating surface is fixed. In other embodiments the angle may be adjusted by the user. Preferably the angle, when set, is about 11 degrees declination of the neutral spine (or 101 degrees if 0 degrees is considered to be the horizontal seat pan). If measuring toward the top of the thoracic curve, the angle would be greater than if measuring near the lumbar curve. Alternatively, the angle may vary between 0 and about 22 degrees declination of the neutral spine (or 90 to about 112 degrees if 0 degrees is considered to be the horizontal seat pan). These angles are only exemplary, and should not be construed to limit the claims.

Figure 4:
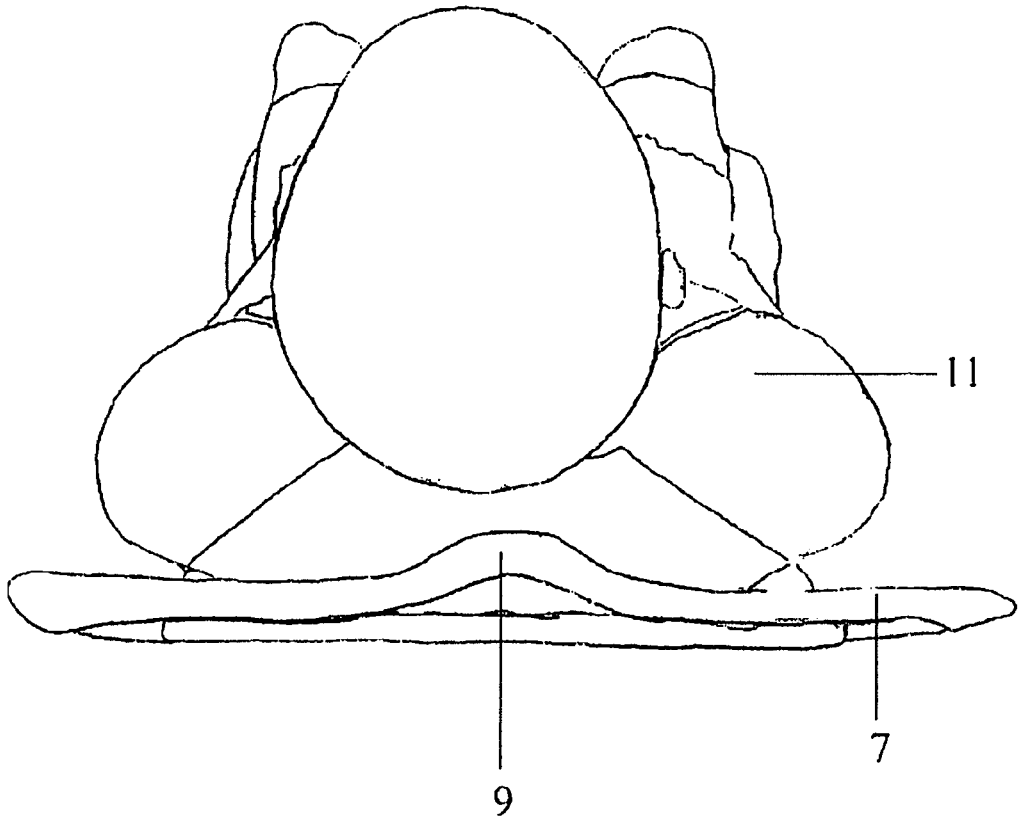
FIG. 4 depicts a top view of an office chair with a back support of one embodiment of the invention, along with an outline of an individual seated in that chair. The medial aspects (vertebral border) of the individual's scapula sit deep into the apex of the thoracic support, and the individual's shoulders have a position that is more posterior than would be found using a traditional back support. This may result in a posterior position or a neutral position.

An example of a curved surface that may be used as a thoracic support column is shown in FIG. 4. In FIG. 4, a chair back 7 includes a thoracic support column 9. FIG. 4 further depicts an individual 11 seated in a chair including an embodiment of a thoracic support column of the invention. It should be noted that the individual's scapula are in a retracted position compared to the position that would be achieved with a conventional chair lacking a thoracic support column. It will be noted that a back support may be created by providing a sheet that is contoured around a convex thoracic support. One such chair is shown in top view in FIG. 4.

Figure 5:
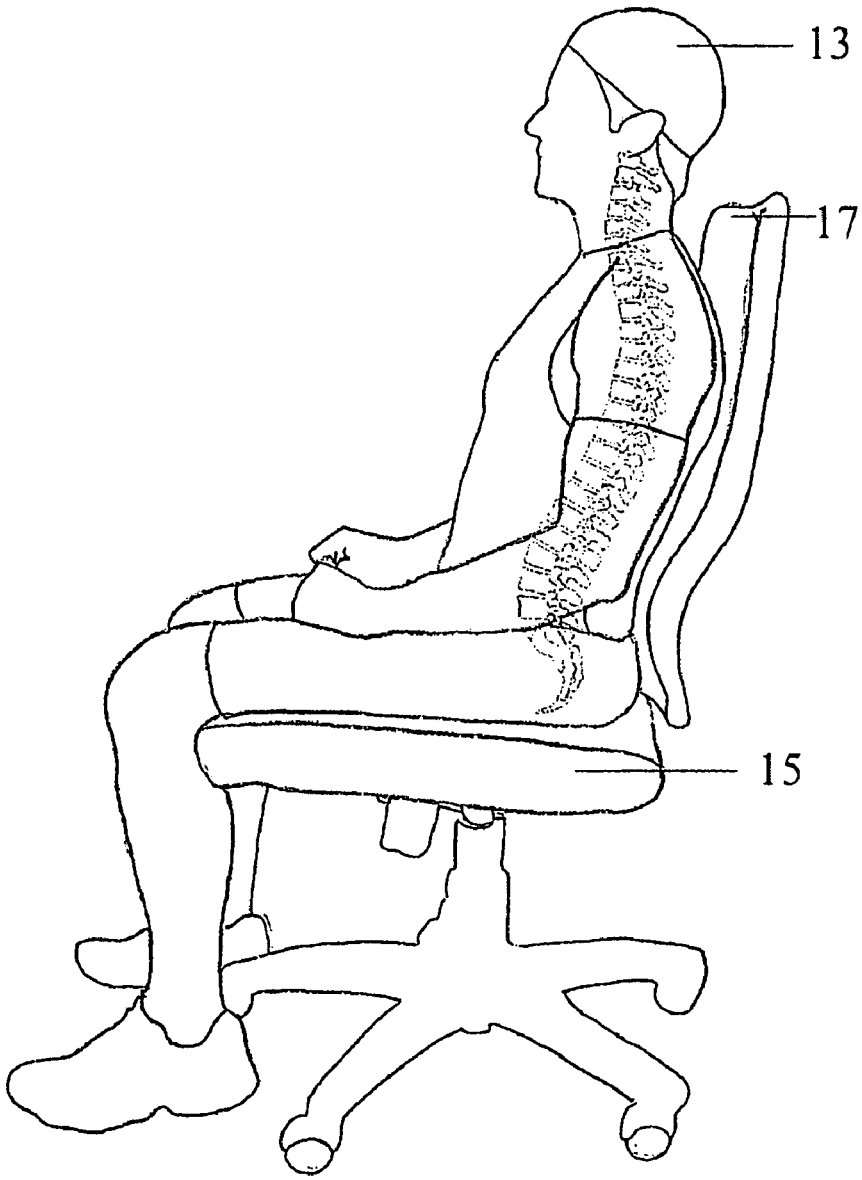
FIG. 5 depicts a side view of an office chair with a back support of one embodiment of the invention, along with an outline of an individual seated in that chair and an example of neutral spine alignment. The back support promotes scapular retraction, allowing the shoulder girdle to assume a neutral or posterior position. This neutral or posterior position allows each curve of the person's body to tend to align with the idealized neutral spine alignment.

Further benefits of a thoracic support column are shown in FIG. 5. FIG. 5 includes a side view of an individual 13 seated in a chair 15 including a chair back with a thoracic support column 17 of the invention. As may be seen in FIG. 5, a seated individual who is able to make use of a thoracic back support is able to exhibit scapular retraction, which allows a more natural alignment of the spine. For a person without a significant number of chest and shoulder adhesions, such a position would be more comfortable than the position encouraged by a traditional chair.

A thoracic support column as used herein may be of any length, though generally it will extend for a distance of about 9 inches above the lumbar vertebrae. For reasons of head comfort, it is preferred that the thoracic support column not extend above the neck height of the user; however, in some embodiments of the invention such extension may occur. In some embodiments, the length of the thoracic support column may be varied during initial manufacture. In some embodiments, the thoracic support column may be situated on a bar or column that allows the thoracic support column to be moved vertically and secured when a desired position is reached. In some embodiments, a thoracic support column comprises multiple nested columns that may be moved vertically independent of each other and secured when a desired position is reached.

Figure 6:
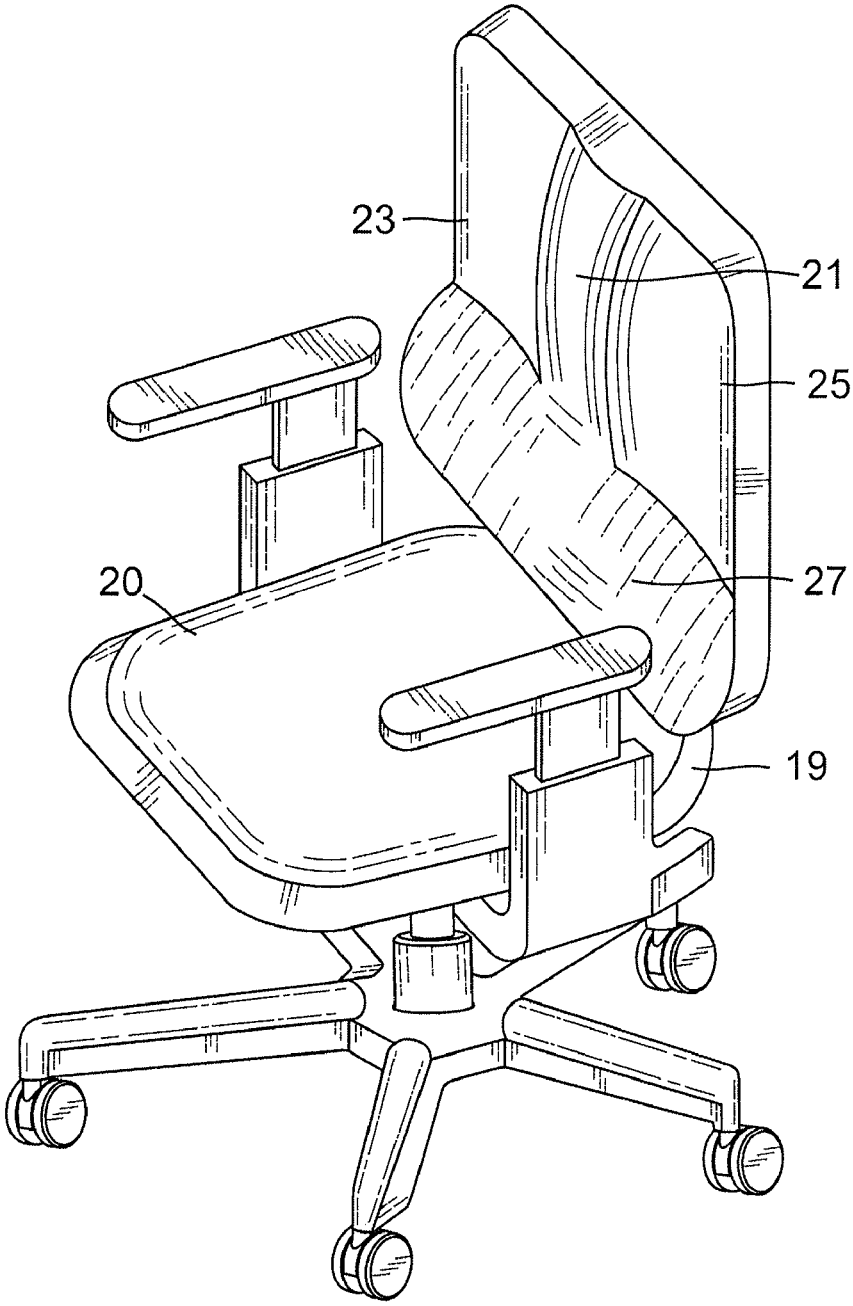
FIG. 6 depicts a perspective view of a chair including a back support of one embodiment of the invention.

FIG. 6 shows an office chair 19 including a seat 20, a thoracic support column 21, recessed sections 23 and 25, both of which allow for scapular retraction, and a lumbar support 27.

Figure 7:
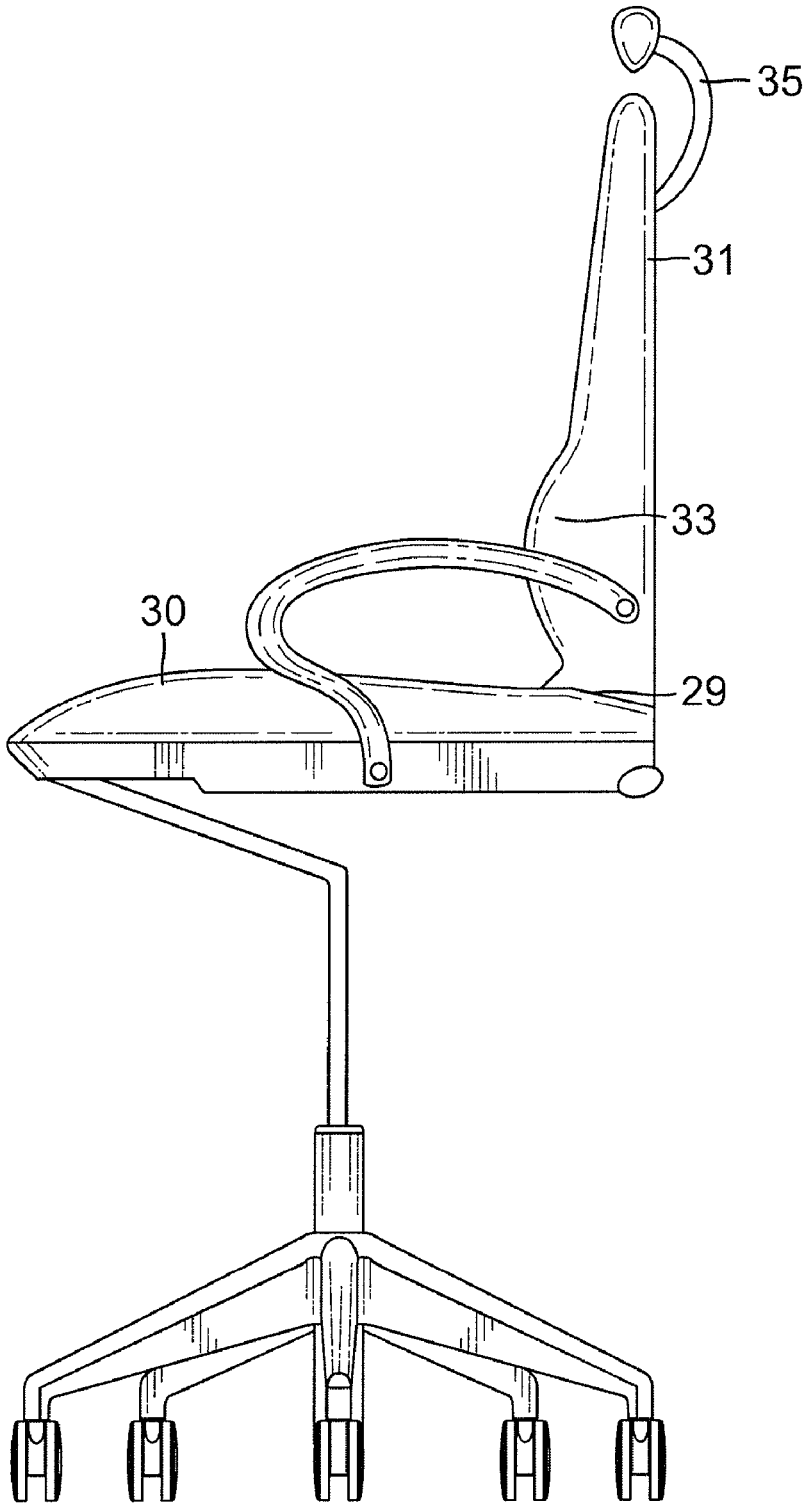
FIG. 7 depicts a side view of a chair including a back support of one embodiment of the invention.

FIG. 7 shows, in profile, another office chair 29, including a seat 30, a thoracic support column 31, a lumbar support 33, and a head support 35. A head support may be, for example, an adjustable head support that may support the occipital bone. It may include vertical adjustment as well as a forward and backward pivot.

Figure 8:
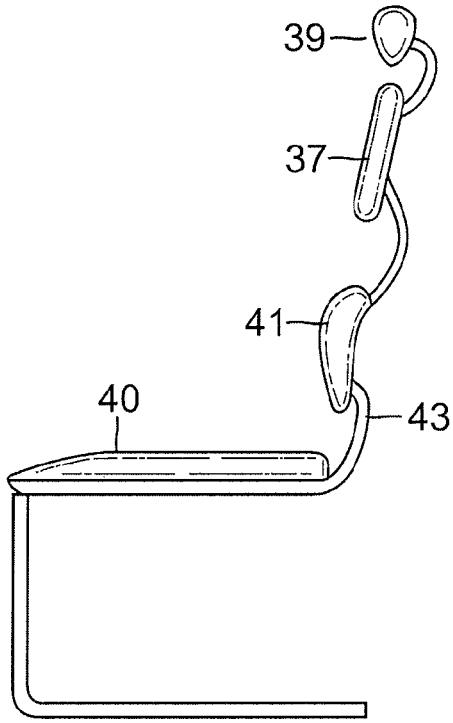
FIGS. 8 and 9 depict front and side views of a chair as a further embodiment of the invention.
Figure 8:
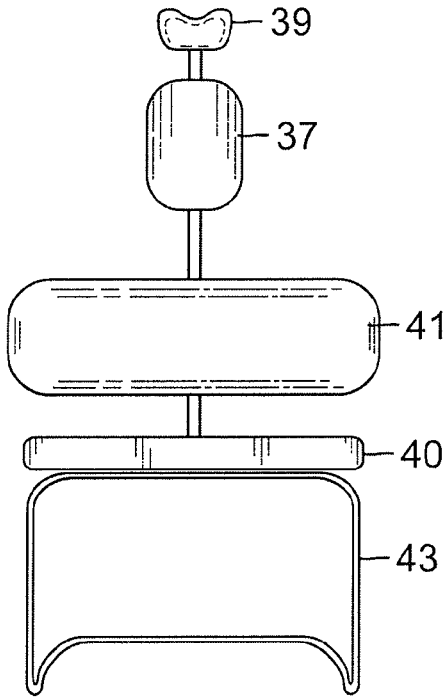

FIG. 8 shows yet another office chair including a thoracic support column 37, a head rest 39, seat 40, lumbar support 41, and frame 43. Mounting points in the frame allow vertical adjustment at each location. This also allows each location to pivot.

Figure 9:
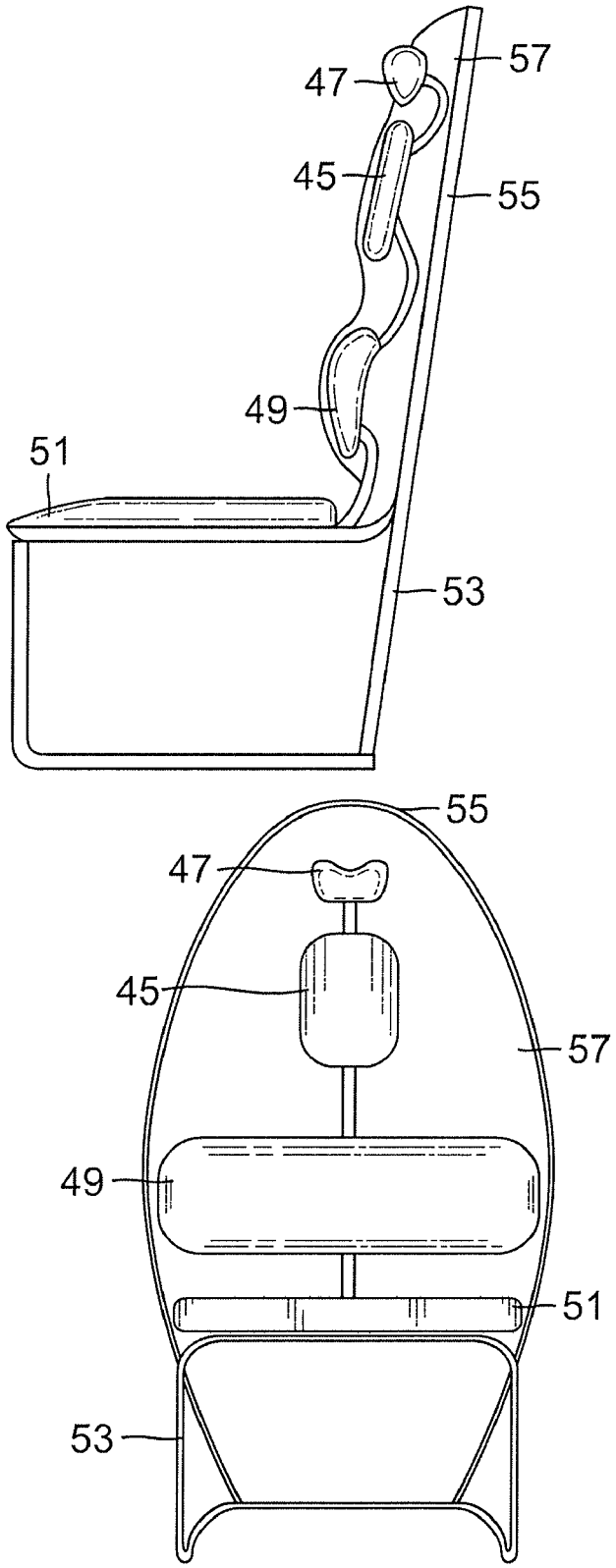

FIG. 9 shows another office chair including a rigid, convex thoracic support column 45, contoured head rest 47 allowing a fit below a user's occipital bone, lumbar support 49, seat 51, frame 53, fabric mounting bar 55, and fabric 57. A layer of fabric goes over the supports and another goes under. The layers may be connected, for example, via zipper mechanisms, stitching, or a hook and eye fastener (for example, Velcro®) forcing the fabric to more closely contour the supports themselves.

Figure 10:
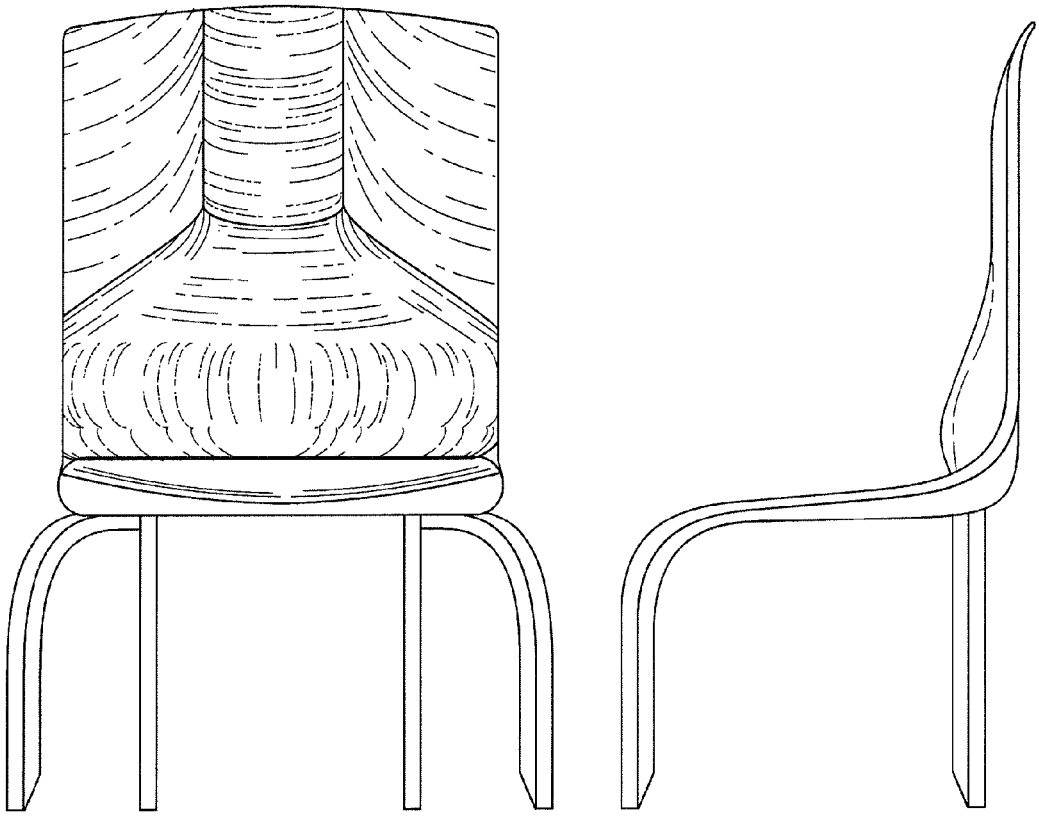
FIG. 10 depicts front and side views of another chair with a back support that is an embodiment of the invention.
Figure 11:
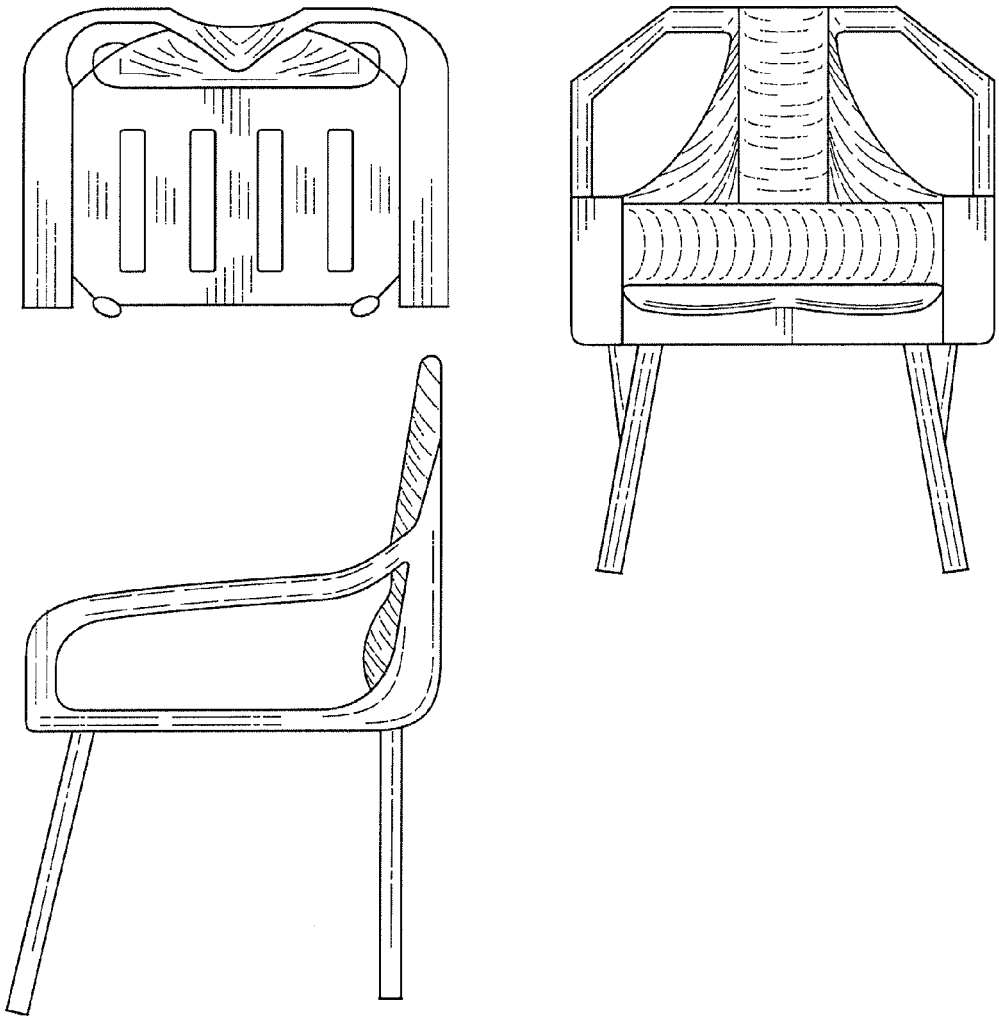
FIG. 11 depicts top, front, and side views of another chair with a back support that is an embodiment of the invention.
Figure 12:
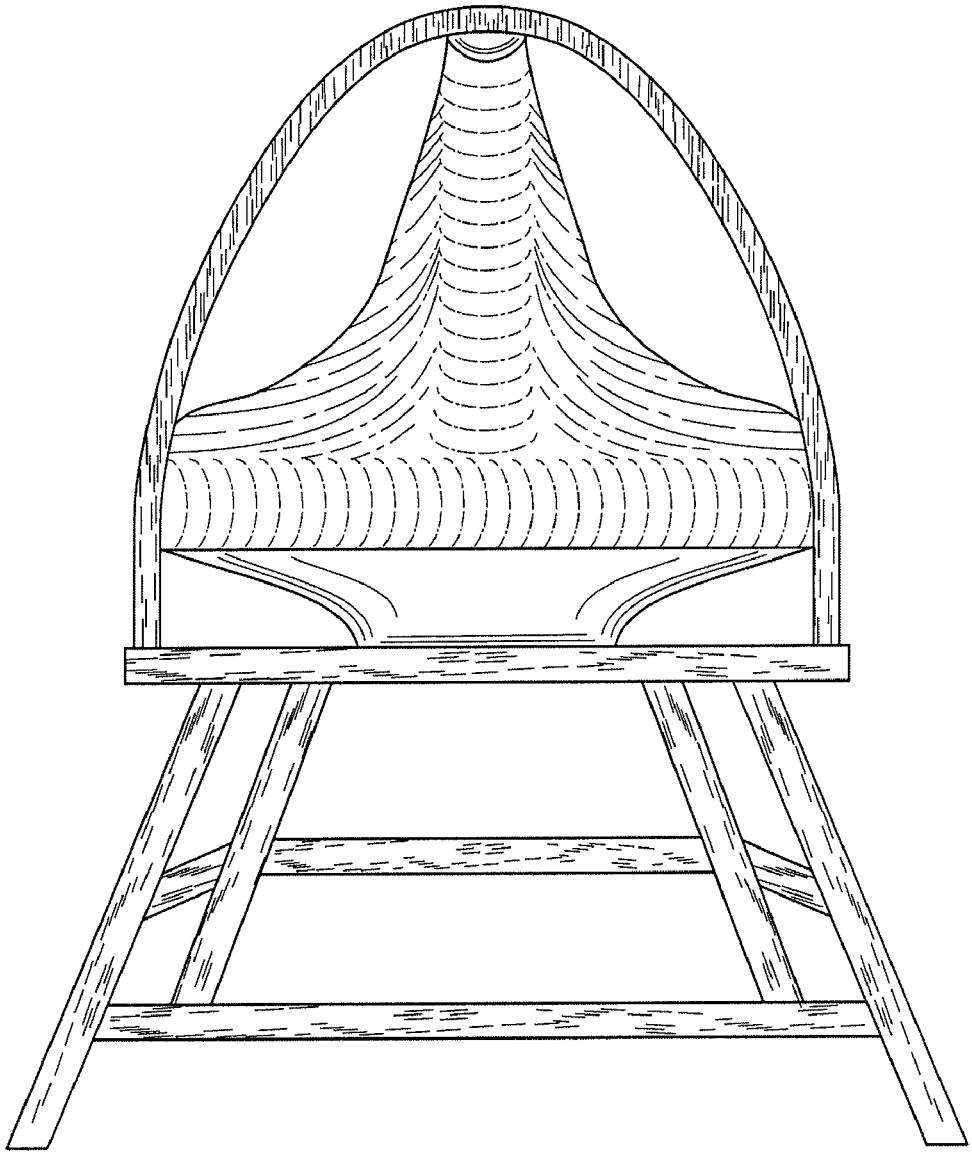
FIG. 12 depicts a further embodiment of the invention.

Back supports including thoracic support columns as described and shown herein may be used in a variety of seating applications. These include, for example, but are not limited to, office chairs, school chairs, dining chairs, couches, love seats, stadium seating, recliners, vehicular seating (including, for example, automobiles, trucks, motorcycles, and school buses), movie theater seating, watercraft seating, and aircraft seating. Examples of various embodiments are shown throughout the figures; for example, various embodiments are shown in FIGS. 10-12 as well as throughout the other figures.

Figure 13:
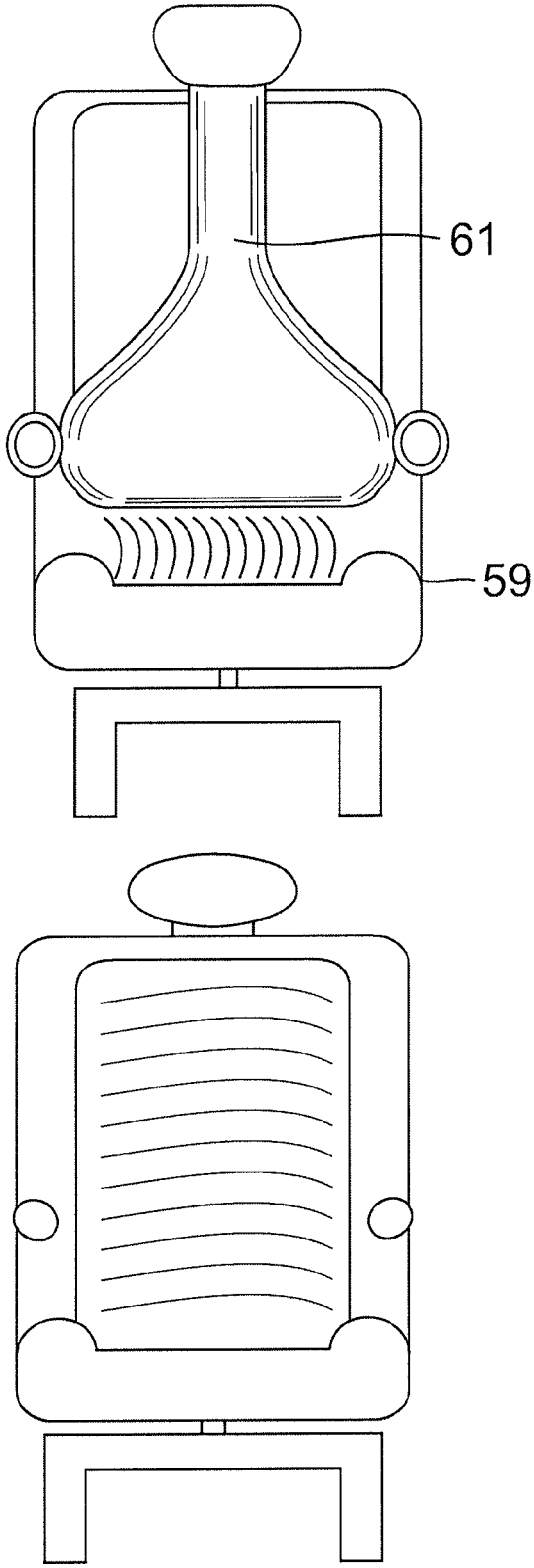
FIGS. 13, 14, and 15 depict embodiments of the invention in which a back support is created or partially created by a shaped fluid bladder.

FIG. 13 shows a chair 59 including a fluid bladder 61 that may include one or more chambers. The fluid bladder may be inflated to provide a stable thoracic support column. The bladder may be rigid or semi-rigid, and its rigidity may be controlled by a user. This could be controlled, for example, by one or more automated or manual pumping controls that regulate displacement of the fluid. The chair of FIG. 13 also includes an elastic material in the chair back, allowing comfortable support when the support column is inflated. The bladder may be filled with, for example, air or water.

Figure 14:
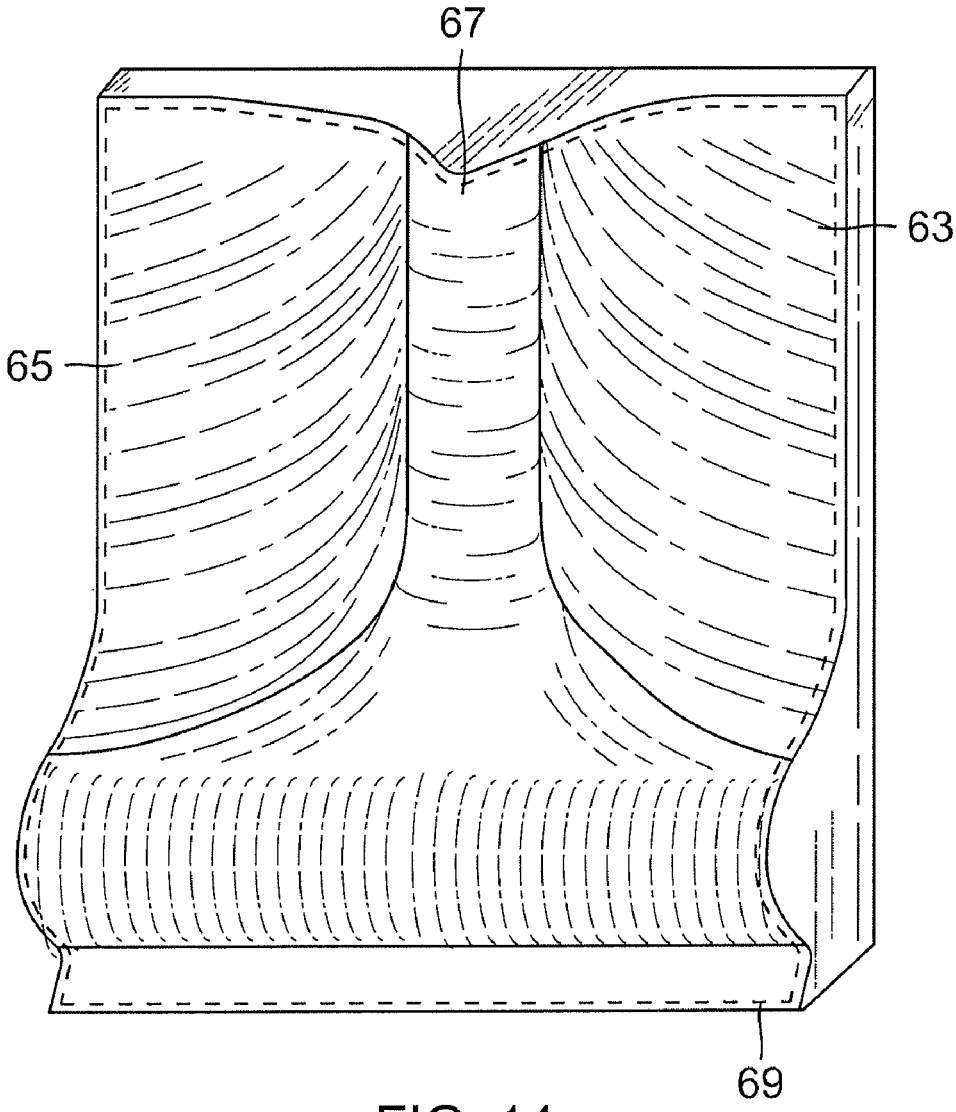

Another fluid bladder chair is shown in FIG. 14. It includes recessed areas 63 and 65 allowing for scapular retraction, as well as rigid convex vertical thoracic support 67. Dashed lines 69 indicate a contoured fluid bladder in a deflated position. Once inflated the bladder will change shape and push the chair's occupant away from lumbar and thoracic supports, and the back rest will take on a desired shape. A fully inflated bladder may create a flat or nearly flat surface. The bladder could also be designed to create a concave shaped surface (or any other desired shape) for the back support at full inflation. As shown in FIG. 14, a fully inflated bladder may create a nearly flat surface. The bladder could also be designed to create a concave shaped surface for the back support at full inflation.

Figure 15:
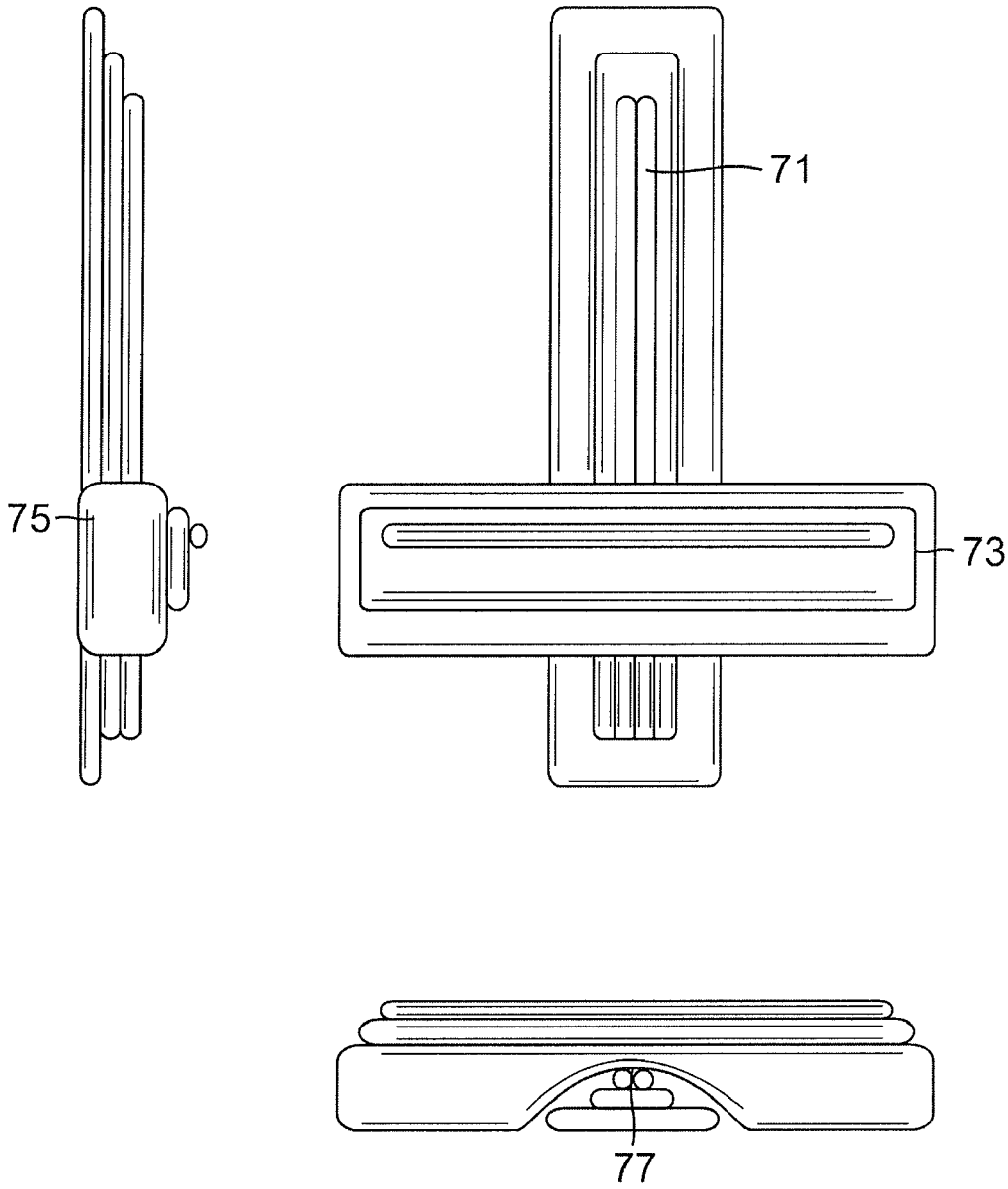

Yet another bladder configuration for a support column and chair is shown in FIG. 15. This chair includes one or more thoracic bladders 71, as well as a lumbar bladder 73 and base bladder 75. When more than one thoracic bladder is present, they may form a gap 77 that may hold the spinous processes.

Figure 16:
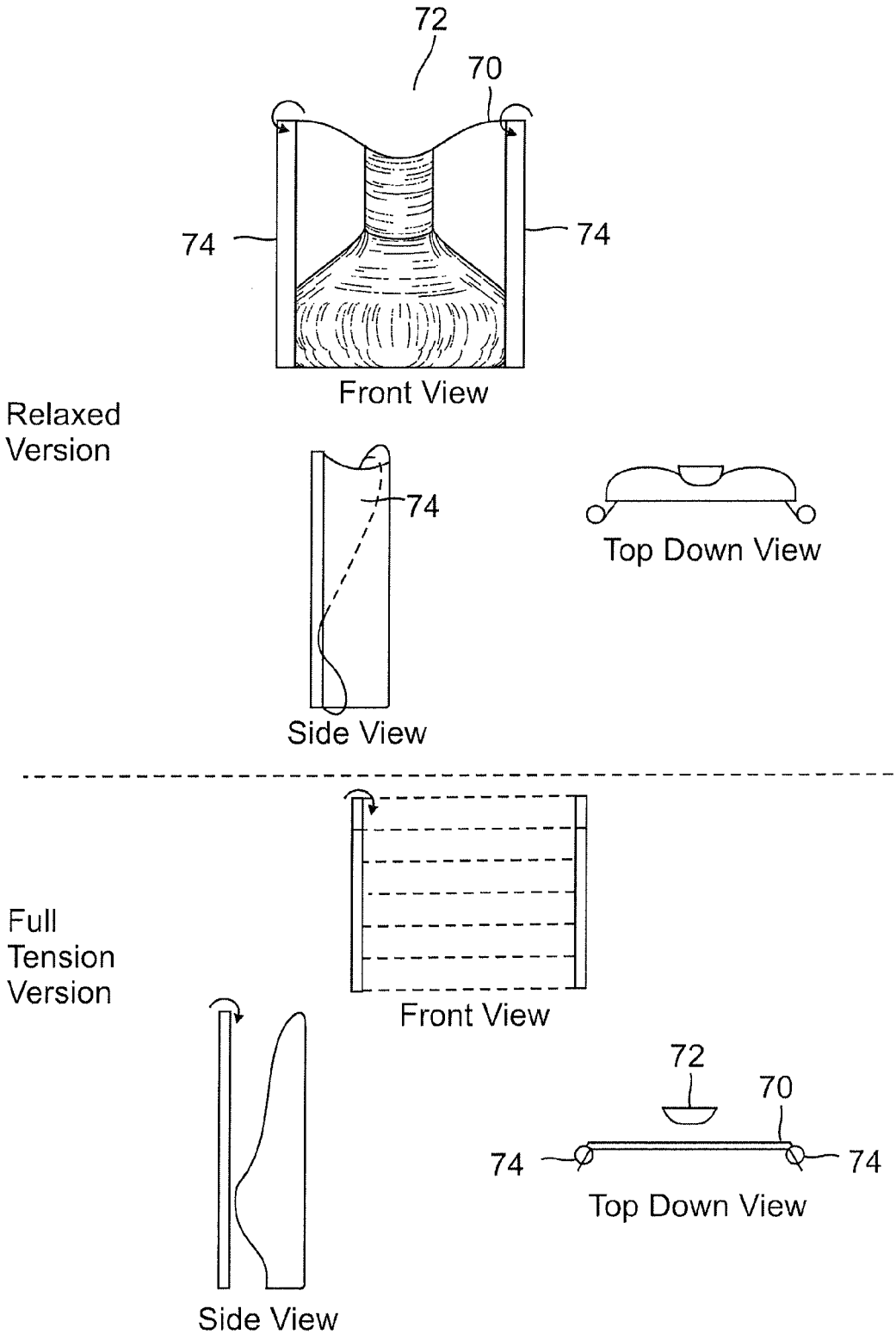
FIG. 16 depicts an embodiment of the invention in which a back support is provided in a retractable fabric apparatus.

FIG. 16 shows a fabric covered thoracic support in which the fabric 70, when tightened, will pull away from the support 72, thus creating a simple flat panel on which the user may rest. The tightening effect of the fabric could be achieved by rotating support columns 74 on either side of the back support. As each column rotates, one clockwise the other counterclockwise, the fabric would either tighten or loosen depending on the direction of rotation.

Figure 17:
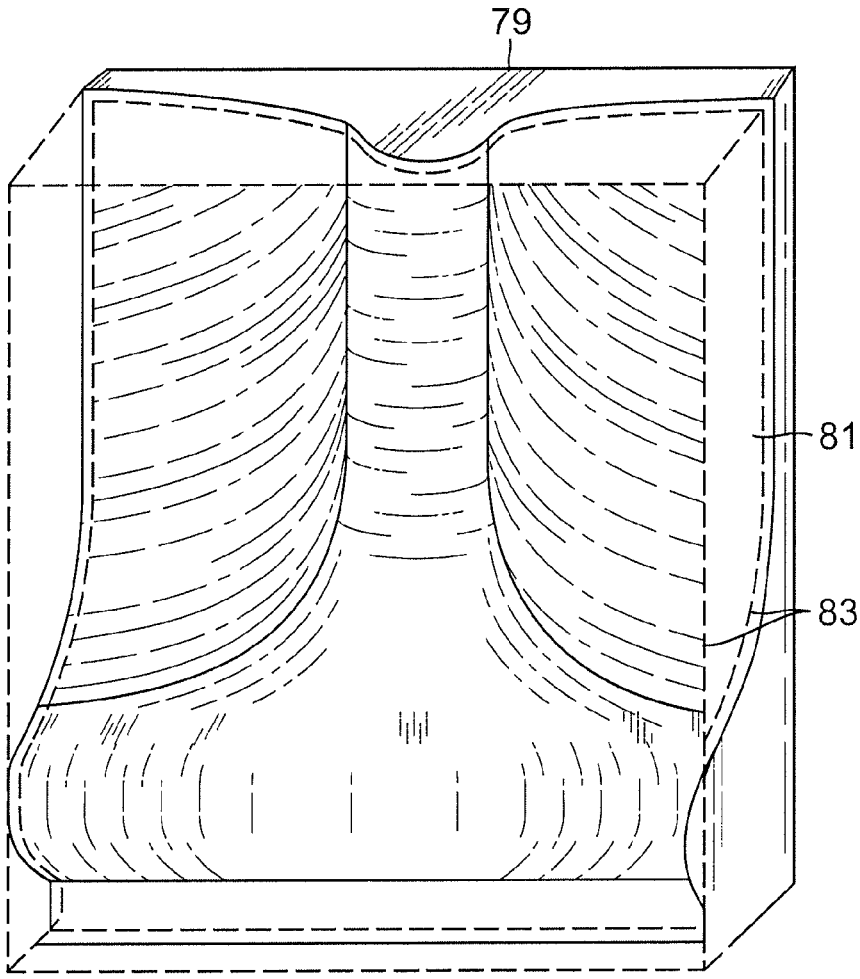
FIG. 17 depicts a back support of one embodiment of the invention. This back support is a foam block including, in its reverse, a contoured support of an embodiment of the invention.

Supports may be constructed from foam. For example, FIG. 17 shows a foam block incorporating both a rigid foam back 79 and a memory or non-rigid foam front 81. Dashed lines 83 show contoured memory foam. Users with generally high mass (for example, adults) may sit against the outer foam layer, which contracts and gives the benefit of support from the underlying rigid foam. Users with lesser mass (for example, children), do not compress the outer foam layer, allowing them to have a seating position not affected by the thoracic support, which may be too large to allow scapular retraction in a small person.

Figure 18:
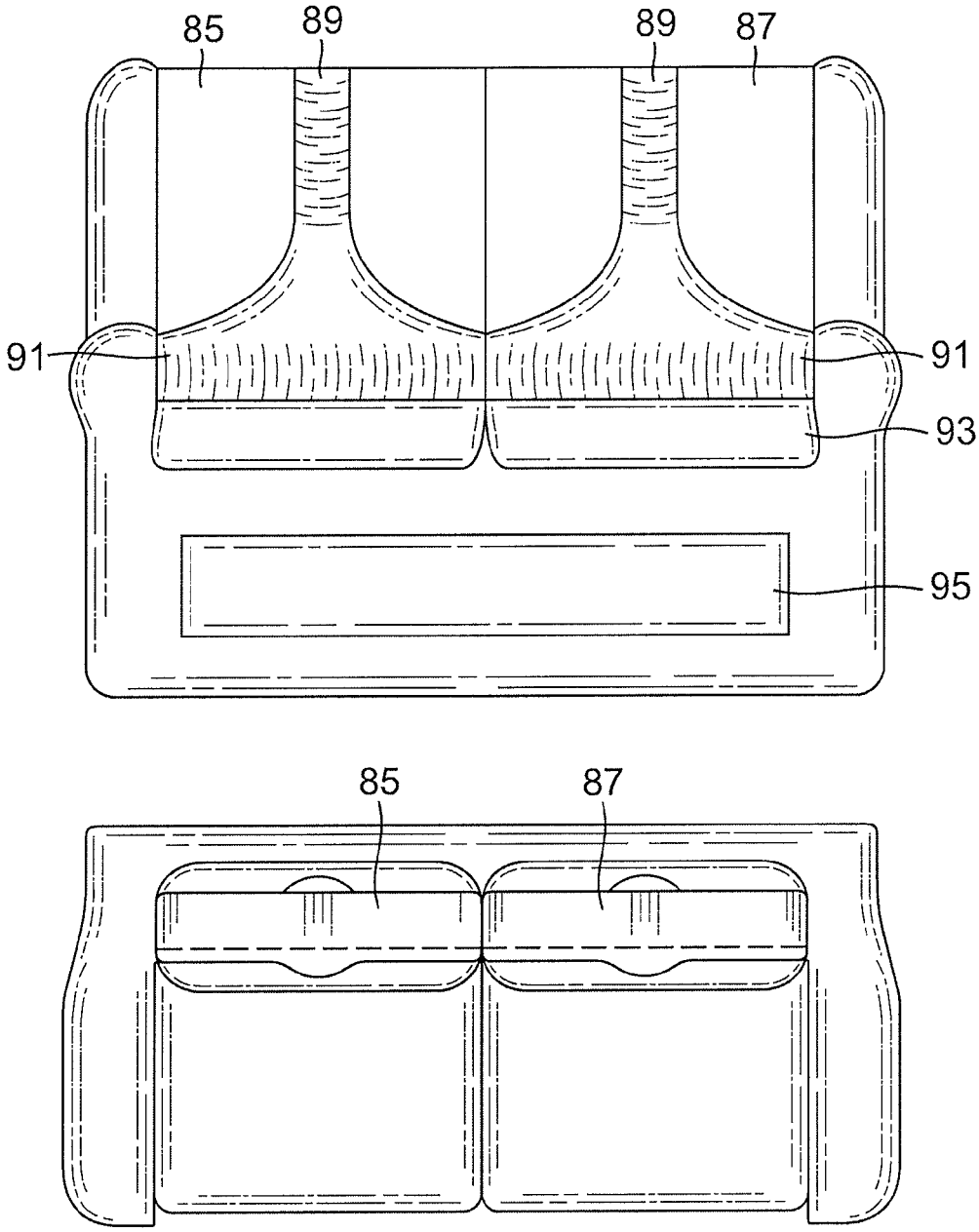
FIG. 18 depicts a love seat including multiple back supports of the invention.

Although many embodiments have been described from the perspective of single-person chairs, thoracic supports are also useful for couches, loveseats, and the like. A loveseat is shown in FIG. 18. It includes two cushions 85 and 87, both of which have thoracic support columns 89 and lumbar supports 91. As an additional feature, the couch or loveseat back may be recessed, allowing both sides of each pillow to have a support, so that the cushions can be reversed after use. In a further embodiment, only one side of each cushion has a thoracic support column, so that the couch can be configured as a conventional couch by reversing the cushions. In another embodiment, the seating area 93 is particularly firm, to maintain proper alignment with the thoracic support. This may have the beneficial effect of permitting a bottom section 95 of the loveseat or couch to be used as storage.

Figure 19:
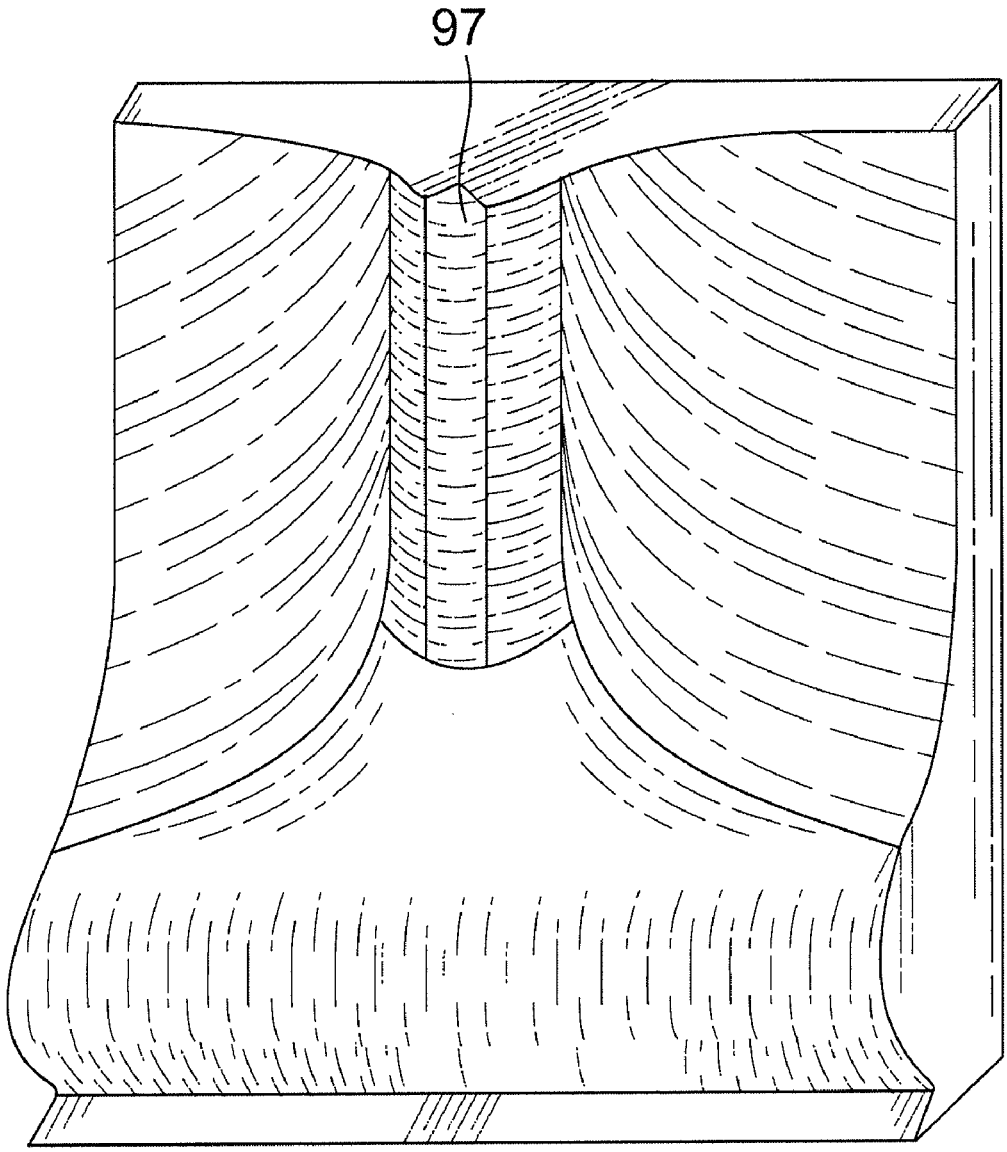
FIG. 19 depicts an embodiment of the invention including a recessed concave section within the vertical thoracic support column.

Although the shape of the thoracic support is generally convex, embodiments of the invention include a concave channel along the edge of the column that is in contact with a user's spine. This is shown as feature 97 in FIG. 19. This concave channel may be made in any embodiment. A channel allows the vertebrae of a seated individual to rest more comfortably in the chair. This effect may also be achieved as shown in FIG. 15.

Figure 20:
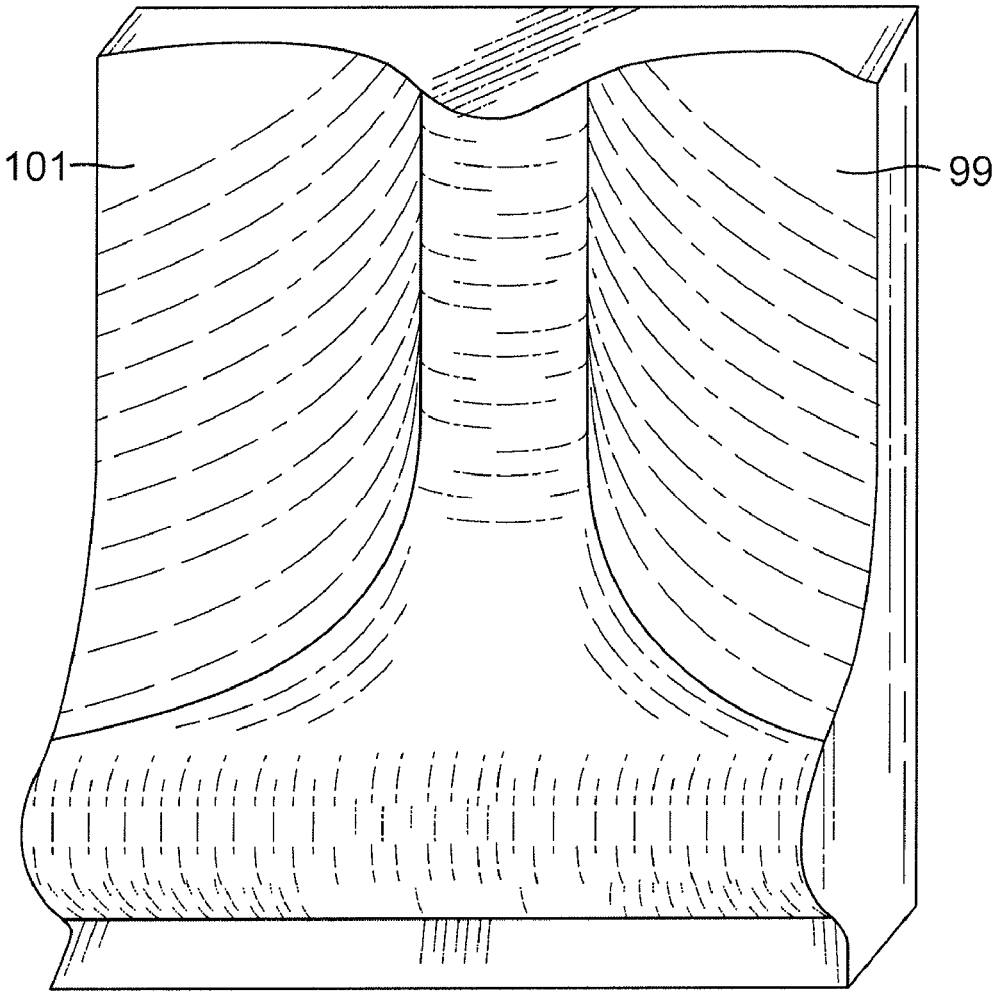
FIG. 20 depicts a back support of one embodiment of the invention, including convex edges for additional lateral support.

In a further embodiment, a lateral support structure is provided to decrease lateral mobility of an occupant. Such an embodiment might be particularly useful, for example, for a person seated in a moving vehicle. One lateral support structure is shown in FIG. 20, at 99 and 101. In this case the lateral support structure is a pair of convex edges. However, the lateral support need not extend the entire length of the back support. For example, lateral support may be limited to the lumbar region, allowing a user's arms to retain a free range of motion.

Figure 21:
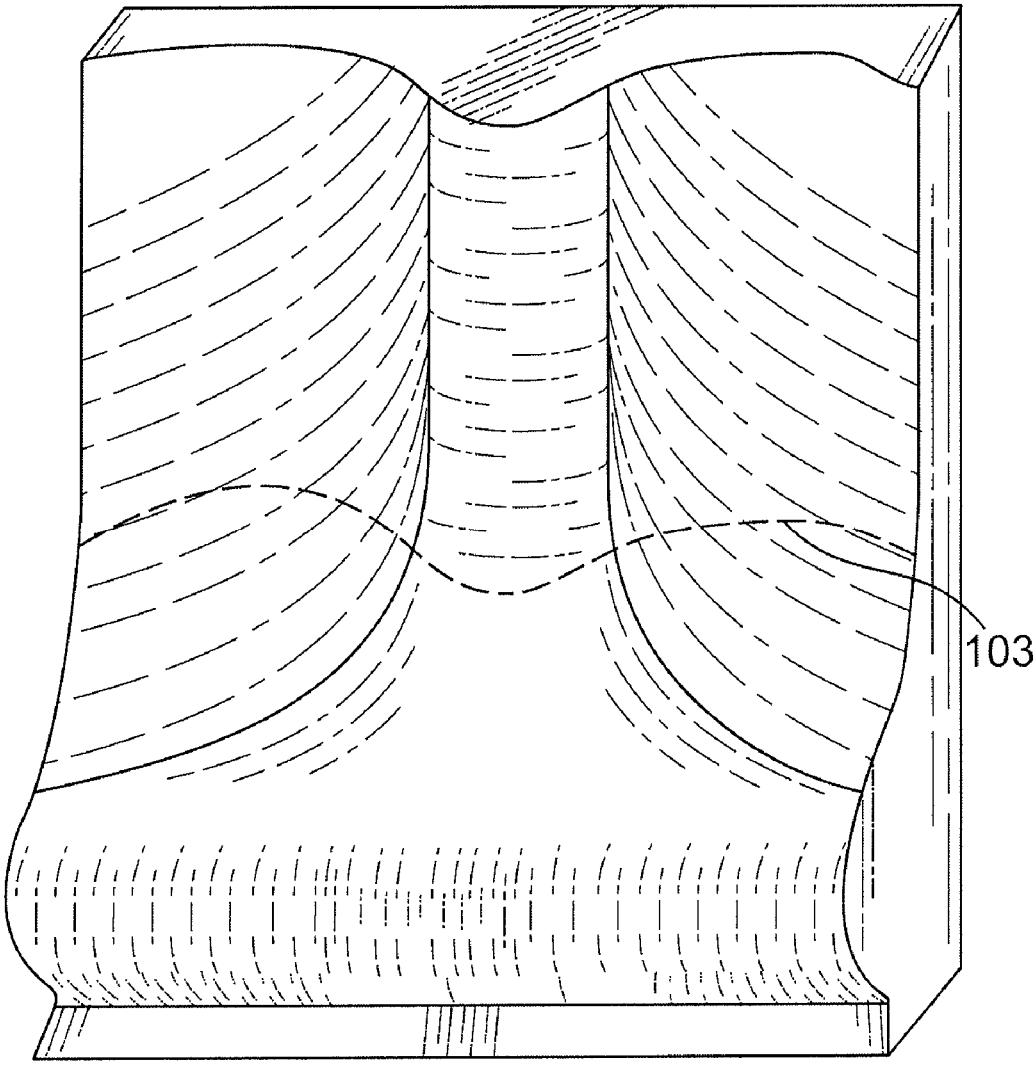
FIG. 21 depicts a back support of one embodiment of the invention, including an adjustable lumbar support.

Embodiments may also provide an adjustable lumbar support. Lumbar adjustment may be accomplished in a variety of ways. One way is shown in FIG. 21, in which the dashed line 103 represents an adjustable lumbar support boundary. In this adjustable lumbar support, the lower region can slide up and down the upper region, allowing for a more custom fit of the lumbar curve.

Figure 22:
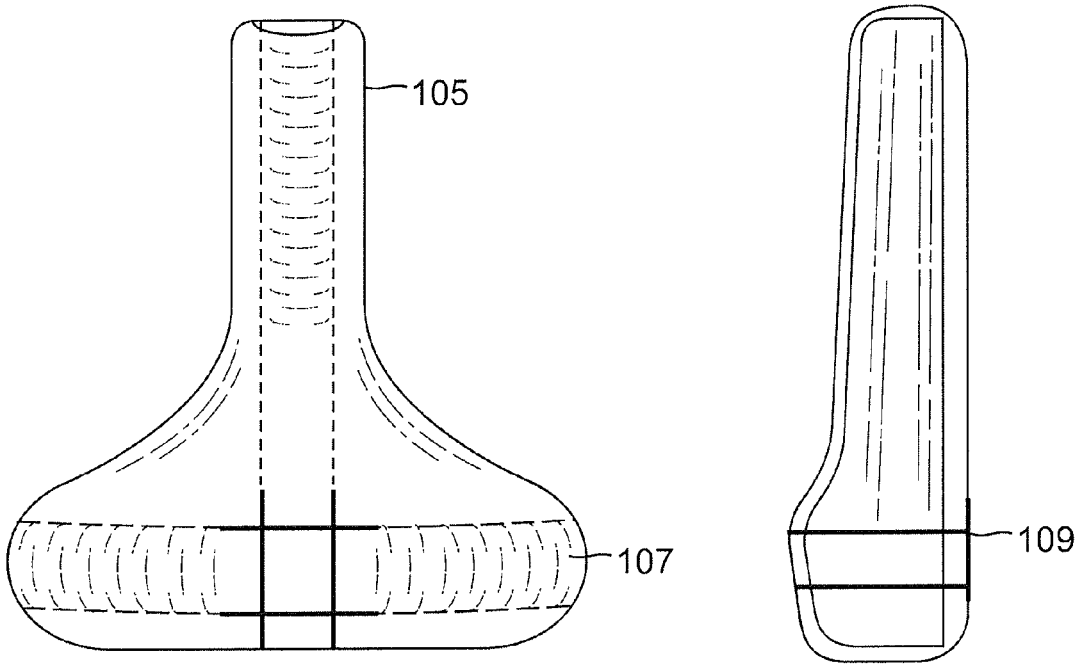
FIG. 22 depicts a back support of a further embodiment of the invention, including a tension harness for attachment of the support to a conventional back support.

Many existing seating devices may be retrofit to have thoracic supports. For example, many office chairs have back portions that are separate from a seating portion. The "stock" back (lacking a thoracic support column) can be replaced with a back having a thoracic support column. Where an existing chair back cannot be removed, or where it is undesirable to do so, a thoracic support may be attached to an existing chair back. One attachable support is shown in FIG. 22. A thoracic support column 105 and a lumbar support 107 are provided, along with a tension harness 109. This support may be attached to an existing chair.

Dimensions of the thoracic support column may be modified to allow for the comfort of large, small, and average individuals. In some embodiments of the invention this modification must be made during construction of the chair. In other embodiments the modification may be adjusted by a user. For example, if the thoracic support column is shaped as part of a cylinder or elliptic cylinder, one may modify the radius of the cylinder or elliptic cylinder to accommodate a person with more or less space between his/her scapula than is average. The lumbar support may be made taller or shorter depending on the lumbar length of the individual. Adjustments may also be made, for example, based on an individual's thoracic curve, cervical curve, and shoulder girdle size.

Typically, a thoracic support will extend upwardly from the point of the spine above the lumbar vertebrae to at least the most inferior portion of the medial aspect (vertebral border)

of the scapula of the seated person. A support may be rigid, meaning that it is not capable of being compressed or bent, or it may be semi-rigid. A semi-rigid support may be bent or partially compressed enough to provide a comfortable seating arrangement, but not enough to forego the benefits of the support.

Typical thoracic support columns as discussed herein will have a radius of about 1 to 4 inches from its apex, with its steepest grade occurring within the first inch, and between about 0.75 inches to about 3.5 inches deep from its apex (where the apex is the point of the convex column designed to touch a seated person's spine). In another embodiment, where the thoracic support column is not included with a more traditional chair back, it may be deeper than 3.5 inches. In a preferred embodiment, as shown in FIG. 8, a thoracic support is about 7 inches tall and about 5 inches wide at its base, and it has a simple linear curve from its apex to its base, with a functional depth of about 2.5 functional inches and a total depth that may be greater. In one embodiment a lumbar support may be, for example, about 20 inches wide and about 6.5 inches tall, with an airfoil shaped curve having an approximate functional depth of about 3 inches. A head support may be, for example about 4 inches wide and about 1.5 inches tall, and may have a 'two-globe' shaped support with a depth of about 1 functional inch.

When integrated into a traditional rectangular chair back, as shown, for example, in FIG. 10, a support may be roughly bell-shaped and have a bottom width of about 20 inches. It will be recognized that although a typical office chair has an approximate width of about 20 inches, both larger and smaller backs are possible, with a general range of about 14 inches to about 30 inches in width, narrowing to a top width of about 4 inches to about 2 inches. An integrated lumbar support may be, for example, about 1 inch to about 6 inches deep from its apex and about 4 inches to about 10 inches tall. It will be recognized that these measurements are exemplary, and they should not be interpreted to limit any aspect of the invention unless included in the claims.

The chairs and other seating apparatus described herein may include other features. For example, they may be made of one or more of a variety of materials, including but not limited to wood, plastic, metal, and polymers. They may have one or more portions covered in textiles; for example, they may be covered by cloth, leather, or vinyl. They may be stackable. the chairs and other seating apparatus may have padding in one or more places. Padding may be, for example, foam, down, or other materials. They may be of unitary construction or constructed from multiple pieces.

The chairs and other seating apparatus may also be capable of adjustment. For example, a chair may be configured to have one or more adjustable aspects including, but not limited to:

- vertical adjustment of the height of the seating surface, for example by a piston;
- swivel mechanism;
- front-axis pivot (also known as a knee tilt), with or without adjustable tension and/or tilt lock;
- mid-axis pivot, with or without tilt lock;
- horizontal seat adjustment, by which a seating surface may move away from or toward the back support;
- seat length adjustment, by which the front portion of the seat would telescope to increase the functional length of the seating surface;
- seat tilt adjustment, including a mid-axis pivot allowing the front of the seating surface to dip below or rise above the back of the seat;
- split seat, whereby the seating surface is split down its center axis, allowing varying adjustment and support of each side of the seating surface;
- vertically and/or horizontally adjusting back support, allowing the back support to move up or down relative to the seating surface, toward the seating surface, or away from the seating surface;
- tilt adjustment for back support, allowing a user to change the angle of the back support;
- vertical and/or horizontal adjusting head support, with or without pivot;
- arm rests, which optionally include vertical, horizontal, and/or transverse slides and pivots; and
- one or more foot rests.

Patents, patent applications, publications, scientific articles, books, web sites, and/or other documents and materials referenced or mentioned herein are indicative of the levels of skill of those skilled in the art to which the inventions pertain, as of the date each publication was written, and all are incorporated by reference as if fully rewritten herein. Additionally, all claims in this application, including but not limited to original claims, are hereby incorporated in their entirety into, and form a part of, the written description of the invention. Applicants reserve the right to physically incorporate into this specification any and all materials and information from any such patents, applications, publications, scientific articles, web sites, electronically available information, and/or other referenced materials or documents. Applicants reserve the right to physically incorporate into any part of this document, including any part of the written description, the claims referred to above including but not limited to any original claims.

As used herein and in the appended claims, the singular forms "a," "an," and "the" include plural reference unless the context clearly dictates otherwise.

The terms and expressions employed herein have been used as terms of description and not of limitation, and there is no intention in the use of such terms and expressions, or any portions thereof, to exclude any equivalents now known or later developed, whether or not such equivalents are set forth or shown or described herein or whether or not such equivalents are viewed as predictable, but it is recognized that various modifications are within the scope of the invention claimed, whether or not those claims issued with or without alteration or amendment for any reason. Thus, it shall be understood that, although the present invention has been specifically disclosed by preferred embodiments and optional features, modifications and variations of the inventions embodied therein or herein disclosed can be resorted to by those skilled in the art, and such modifications and variations are considered to be within the scope of the inventions disclosed and claimed herein.

Specific methods and apparatuses described and depicted herein are exemplary and not intended as limitations on the scope of the invention. Other objects, aspects, and embodiments will occur to those skilled in the art upon consideration of this specification, and are encompassed within the spirit of the invention as defined by the scope of the claims. Where examples are given, the description shall be construed to include, but not to be limited to, only those examples. It will be readily apparent to one skilled in the art that varying substitutions and modifications may be made to the invention disclosed herein without departing from the scope and spirit of the invention, and from the description of the inventions, including those illustratively set forth herein, it is manifest that various modifications and equivalents can be used to implement the concepts of the present invention without departing from its scope. A person of ordinary skill in the art will recognize that changes can be made in form and detail without departing from the spirit and the scope of the invention. The described embodiments are to be considered in all respects as illustrative and not restrictive. Thus, for example, additional embodiments are within the scope of the invention and within the following claims.

We claim:

1. A method for promoting scapular retraction in a person in a seated or reclining position, comprising:

seating the person on a seat portion of a seating device, the seating device comprising a rigid or semi-rigid thoracic support column that is positioned and aligned to extend upwardly and fixably from at or above the seated person's lumbar vertebrae to at or above the person's superior scapular aspect, the thoracic support column having a convex cross section projecting from a side facing the person, the convex cross section of the thoracic support column being shaped to fit between the person's scapulae, the seating device further comprising a scapular indentation situated on either side of the thoracic support column, the scapular indentations being sized to allow the person's scapulae to move in the rearward direction and to contact the scapular indentations in a fully retracted position as promoted by the thoracic support column, thereby distributing a supporting force on the person over a larger surface area;

supporting the person's back against the thoracic support column, wherein pressure resulting from the supporting against the thoracic support column promotes retraction of the person's scapulae in a rearward direction.

2. The method of claim 1, wherein the seating device is a chair and the thoracic support column comprises part of a back of the chair.

3. The method of claim 2, wherein the chair is selected from the group consisting of folding chairs, rolling chairs, stadium seats, love seat, couch, stackable chairs, student chairs, airplane seats, helicopter seats, office chairs, school chairs, dining chairs, theater seats, watercraft seats, and ground vehicle seats.

4. The method of claim 1, wherein the thoracic support column further comprises a central groove that is aligned along the side of the convex cross section that faces the person.

5. The method of claim 1, wherein the seating device further comprises at least one of a headrest and a lumbar support.

6. The method of claim 1, wherein the thoracic support column does not comprise an inflatable structure.

7. The method of claim 1, wherein the convex protrusion has a first radius of curvature at a first position further from the seat portion that is smaller than a second radius of curvature at a second position closer to the seat portion.

8. A chair comprising:

a seat having a topside, an underside, a front edge, and a back edge, the underside being disposed opposite the top side and the back edge being disposed opposite to the front edge;

a back support that projects upward from the top side of the seat near the back edge of the seat, the back support comprising a rigid or semi-rigid thoracic support column having a convex cross section projecting forward from the back support toward a user seated on the seat, the thoracic support column being positioned and aligned to extend upwardly and fixably from at or above the user's lumbar vertebrae to at or above the user's superior scapular aspect, the convex cross section of the thoracic support column being shaped to fit between the user's scapulae to promote rearward retraction of the scapulae when the user is seated and reclined against the back support, the back support further comprising a scapular indentation situated on either side of the thoracic support column, the scapular indentations being sized to allow the person's scapulae to move in the rearward direction and to contact the scapular indentations in a fully retracted position as promoted by the thoracic support column, thereby distributing a supporting force on the person over a larger surface area.

9. The chair of claim 8, wherein the thoracic support column further comprises a groove that follows an up-down axis of the convex protrusion at an apex of the protrusion, the groove providing a recess to prevent direct contact between the convex protrusion and vertebrae of the user.

10. The chair of claim 8, further comprising at least one member of the group consisting of a headrest, a lumbar support, a plurality of armrests, a footrest, a swivel mechanism, a height adjustment assembly, a front-axis pivot, a mid-axis pivot, a horizontal seat adjustment, a seat length adjustment, a seat-tilt adjustment, a split in said seat, a horizontal adjustment for said back, a vertical adjustment for said back, a vibration function, a heating function, a cooling function, a thermostat, and a tilt for said back.

11. The chair of claim 8, wherein the thoracic support column is a rigid support column.

12. The chair of claim 8, wherein the thoracic support column has a base end nearer the seat and a topmost end further from the seat and the convex protrusion has an apex positioned nearest the user, the thoracic support column being about 2 inches to about 8 inches wide at the base end and about 2 inches wide at the topmost end, and the convex protrusion being about 0.75 inches to about 3.5 inches deep at the apex, the convex protrusion having a first radius of curvature near the base end of the thoracic support column that is larger than a second radius of curvature near the topmost end of the thoracic support column.

13. The chair of claim 8, wherein the thoracic support column is selected from a cylinder, an elliptic cylinder, and a cylindrical section.

14. The chair of claim 8, wherein the thoracic support column does not comprise an inflatable structure.

15. The chair of claim 8, wherein the convex protrusion has a first radius of curvature at a first position further from the seat that is smaller than a second radius of curvature at a second position closer to the seat.

16. A thoracic support for a seating or reclining apparatus, the thoracic support comprising:

a front side that against which a person using the seating or reclining apparatus leans, the front side comprising a convex protrusion that is shaped to fit between scapulae of the person to promote a rearward retraction of the scapulae, the convex protrusion extending from at or above the person's lumbar region to the person's superior scapular aspect region, the front side further comprising two similarly shaped scapular recessions, one on either side of the convex protrusion, each scapular recession providing being sized to allow the person's scapulae to experience the rearward retraction and to contact the scapular recession in a fully retracted position as promoted by the thoracic support column, thereby distributing a supporting force on the person over a larger surface area; and means for fixing the thoracic support in a position to promote the rearward scapular retraction.

17. The thoracic support of claim 16, further comprising a groove in the convex protrusion, the groove following an up-down axis of the convex protrusion at an apex of the protrusion, the groove providing a recess to prevent direct contact between the convex protrusion and vertebrae of the person.

18. The thoracic support column of claim 16, wherein the convex protrusion does not comprise an inflatable structure.

19. The thoracic support column of claim 16, wherein the convex protrusion has a first radius of curvature at a first position closet to the person's scapulae that is smaller than a second radius of curvature at a second position closer to the person's lumbar region.

20. The back support of claim 16, further comprising:

a seat comprising a topside, an underside, a front edge, and a back edge, the underside being disposed opposite the top side and the back edge being disposed opposite to the front edge; and a back support that projects upward from the top side of the seat near the back edge of the seat, the back support comprising the thoracic support column.

21. A thoracic support for a seating or reclining apparatus, the thoracic support comprising:

a front side that against which a person using the seating or reclining apparatus leans, the front side comprising a convex protrusion that is shaped to fit between scapulae of the person to promote a rearward retraction of the scapulae, the convex protrusion extending from at or above the person's lumbar region to the person's superior scapular aspect region, the convex protrusion having a groove that follows an up-down axis of the convex protrusion at an apex of the protrusion, the groove providing a recess to prevent direct contact between the convex protrusion and vertebrae of the person; and means for fixing the thoracic support in a position to promote the rearward scapular retraction.

* * * * *